US008957641B1

(12) United States Patent
Hsu

(10) Patent No.: US 8,957,641 B1
(45) Date of Patent: Feb. 17, 2015

(54) MAGNETIC CONTROLLED POWER GENERATOR

(71) Applicant: Chi Hua Fitness Co., Ltd., Hsinchu County (TW)

(72) Inventor: Cheng-Chien Hsu, Hsinchu County (TW)

(73) Assignee: Chi Hua Fitness Co., Ltd., Hsinchu County (TW)

( * ) Notice: Subject to any disclaimer, the term of this patent is extended or adjusted under 35 U.S.C. 154(b) by 0 days.

(21) Appl. No.: 14/037,627

(22) Filed: Sep. 26, 2013

(51) Int. Cl.
*H02K 7/02* (2006.01)

(52) U.S. Cl.
CPC ..... *H02K 7/02* (2013.01)
USPC ..... 322/4

(58) Field of Classification Search
USPC ..... 322/4; 310/74, 153; 74/572.1; 318/150, 318/161
See application file for complete search history.

(56) References Cited

U.S. PATENT DOCUMENTS

| | | | | |
|---|---|---|---|---|
| 6,084,325 | A * | 7/2000 | Hsu | 310/74 |
| 7,018,324 | B1 * | 3/2006 | Lin | 482/63 |
| 7,385,324 | B2 * | 6/2008 | Lin | 310/74 |
| 7,732,961 | B2 * | 6/2010 | Lin | 310/153 |
| 8,134,265 | B2 * | 3/2012 | Maekawa et al. | 310/156.12 |
| 8,269,470 | B2 * | 9/2012 | Wu et al. | 322/4 |
| 8,633,625 | B2 * | 1/2014 | Palazzolo et al. | 310/90.5 |
| 8,791,613 | B2 * | 7/2014 | Wang | 310/90.5 |
| 2008/0297120 | A1 * | 12/2008 | Potter et al. | 322/4 |
| 2014/0035414 | A1 * | 2/2014 | Hsieh | 310/96 |
| 2014/0125171 | A1 * | 5/2014 | Bremer et al. | 310/74 |

* cited by examiner

*Primary Examiner* — Tulsidas C Patel
*Assistant Examiner* — Viet Nguyen
(74) *Attorney, Agent, or Firm* — Rosenberg, Klein & Lee

(57) ABSTRACT

A magnetic controlled power generator provides a magnetic controlled loading device, power generator and flywheel device to form two independent modules which are easily assembled and disassembled for easy manufacture and maintenance. Besides, the magnetic controlled power generator has simple installation and lightweight components to generate a radial displacement for magnetic flux control, achieving continuous adjustment of the load resistance, thereby having the effect of reducing the cost and weight.

6 Claims, 9 Drawing Sheets

MAGNETIC CONTROLLED POWER GENERATOR

BACKGROUND OF THE INVENTION

1. Field of the Invention

The invention relates to a magnetic controlled power generator, to rearrange the relative location of the magnetic controlled loading device, power generator, and flywheel device to form two independent modules for easy assembly and disassembly.

2. Description of the Related Art

Sports equipment with a magnetic controlled power generator can produce flywheel inertia force, power generation and magnetron load regulation. The magnetic controlled power generator includes a magnetic controlled loading device, power generator and flywheel.

A magnet rotates with the flywheel to form a magnetic circuit of the armature core for a coil of the armature core producing electricity, which is the principle of a permanent-magnet alternating current generator. The magnetic controlled power generator uses this principle by making the flywheel as the source for the alternating current generator, so that the voltage produced will go through a power line into an AC/DC converter. This will provide the power for the magnetic controlled loading device and achieve electrical loading control. Further, the eddy current resistance is formed by using changes in the magnetic field, thus becoming a breaking loading method. Its fundamental principle is using a conductive metal plate and moving it through a magnetic field. The magnetic fields opposing the change, or so called "eddy current." Moreover, according to Maxwell's Equation, the intensity of the magnetic force is in direct proportion to the square of magnetic flux density. The magnetic force can be applied to the exercise machine's braking loading.

However, the prior art disclosed above has the following drawbacks:

1. If the magnetic controlled loading device, power generator and flywheel have poor compatibility, the magnetron load regulation, power generation efficiency and flywheel inertia forces will affect sports equipment and thus it is difficult to assemble and repair the components.

2. If the loading portion uses permanent magnets as its magnetic field source, then it is very difficult to link up to external digital signals, and thereby unable to attain the goal of computerization and digitization, unless there is a motor and motor controller to change the relative location of the magnets and conductors, or utilizing magnetic wire coils and external power sources to overcome these problems.

Therefore, the inventor has studied the problems mentioned above and made improvements to overcome the problems.

SUMMARY OF THE INVENTION

It is an object of the present invention to provide a magnetic controlled power generator to provide two independent modules to be easily assembled and disassembled for easy manufacture and maintenance.

It is another object of the present invention to provide the magnetic controlled power generator with simple installation and lightweight components to generate a radial displacement for magnetic flux control, achieving continuous adjustment of the load resistance, thereby having the effect of reducing the cost and weight.

In order to achieve the above objects, the magnetic controlled power generator comprises a flywheel device having a first bearing disposed within a hub of the flywheel device, the flywheel device being recessed under a wheel rim, which forms an accommodating space, a metal conductor being mounted on an inner surface of the wheel rim; a magnetic controlled loading device arranged within the accommodating space of the flywheel device to form a magnetic controlled power generator; wherein the flywheel device includes an annular body being arranged within the accommodating space and being concentric with an axis of the hub to form an inner annular groove and outer annular groove within the accommodating space, the annular body has a first magnet at an inner side thereof, a transmission element is arranged at an outer side of the flywheel device to drive the flywheel device for rotation, and the transmission element has at least a second bearing inserted therein; and the magnetic controlled loading device includes a coil holder; a shaft penetrating through the coil holder; an armature core mounted to a rear side of the coil holder; a rear frame having a groove opposing to the armature core in the center of a shaft hole for arranging the armature core, the armature core being fitted in the inner annular groove of the accommodating space for the rotation of the first magnet of the annular body corresponding to the electricity generation of the fixed armature core, the groove having a first positioning hole in the center corresponding to a front side of the coil holder thereof; a pair of pole pieces being opposite facing circular shapes and having a pair of second magnets arranged on an outer side thereof and a compression spring fitted to an inner side thereof, the pole pieces each further having an end swiveled in a pivot and a movable free end, the pivot of the pole pieces being diagonally positioned on the rear frame, a pull rope being joined to the free end; a front frame adapted to match the rear frame, the front frame having a second positioning hole corresponding to the first positioning hole, the front frame being joined to the rear frame and the coil holder with a plurality of screws so that the pole pieces are located between the two frames and fitted in the outer annular groove of the accommodating space; a slide and a stepped surface being arranged near the pull rope between the two frames the slide being radially located on a top of the stepped surface; an adjustment block being arranged within the slide for radial displacement, the adjustment block having two positioning grooves facing to the corresponding pull ropes at the free ends of the pole pieces and formed at both sides of the adjustment block for the pull ropes respectively passing through both sides of the slide to the two positioning grooves; and an adjusting drive mechanism passing through the stepped surface to connect a lower end of the adjustment block, which is selectable to use an electric or a manual adjustment method to drive the adjustment block for a radial sliding movement; whereby the shaft of the magnetic controlled loading device joints to the hub of the flywheel device to form the magnetic controlled power generator.

Further, the shaft has a C-buckle fixed at a rear end of the shaft and abutted to the second bearing. A one-way clutch bearing is arranged between the hub and the transmission element.

Further, the slide has a plurality of rollers pivotally connected between the two frames; the plurality of rollers is symmetrically located at the top to the bottom of both sides of the slide; the pull ropes respectively circles around the rollers and passes through a side of the slide to connect to the positioning groove. The adjustment block has an inclined face at an upper surface thereof; the inclined face is parallel to the positioning groove. The pivot has a bush thereon.

DETAILED DESCRIPTION OF THE PREFERRED EMBODIMENT

Figure 1:
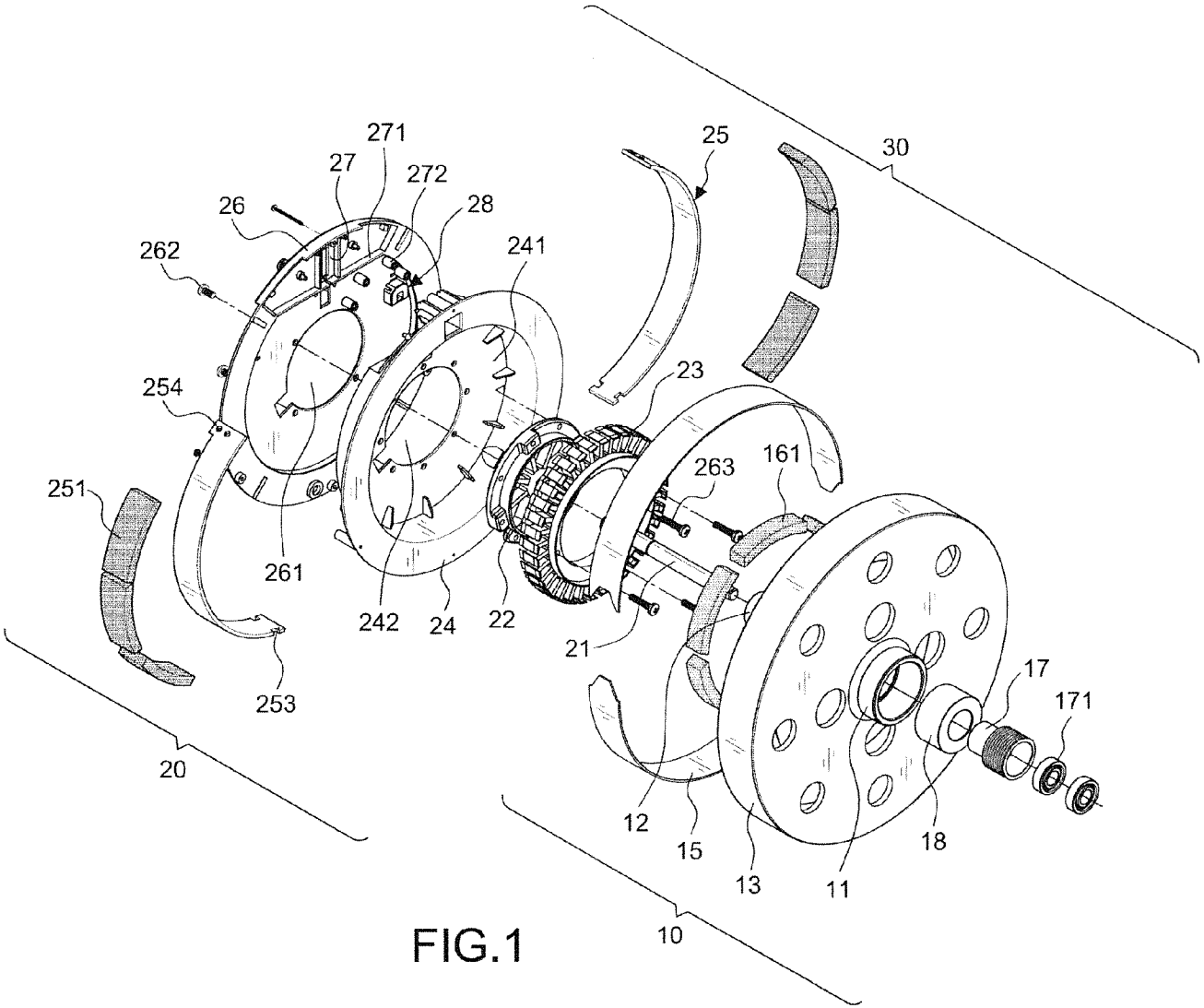
FIG. 1 is an exploded perspective view of the preferred embodiment in accordance with the present invention.
Figure 2:
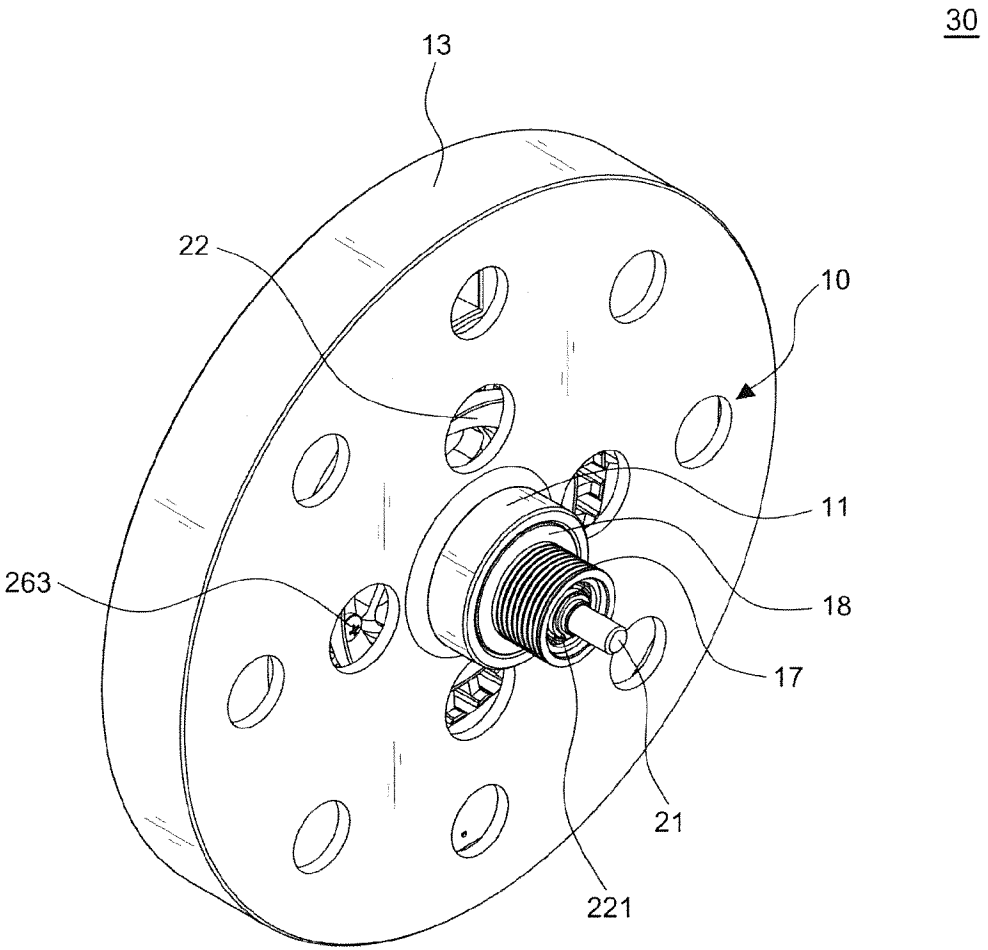
FIG. 2 is an assembly perspective view of the preferred embodiment in accordance with the present invention.
Figure 3:
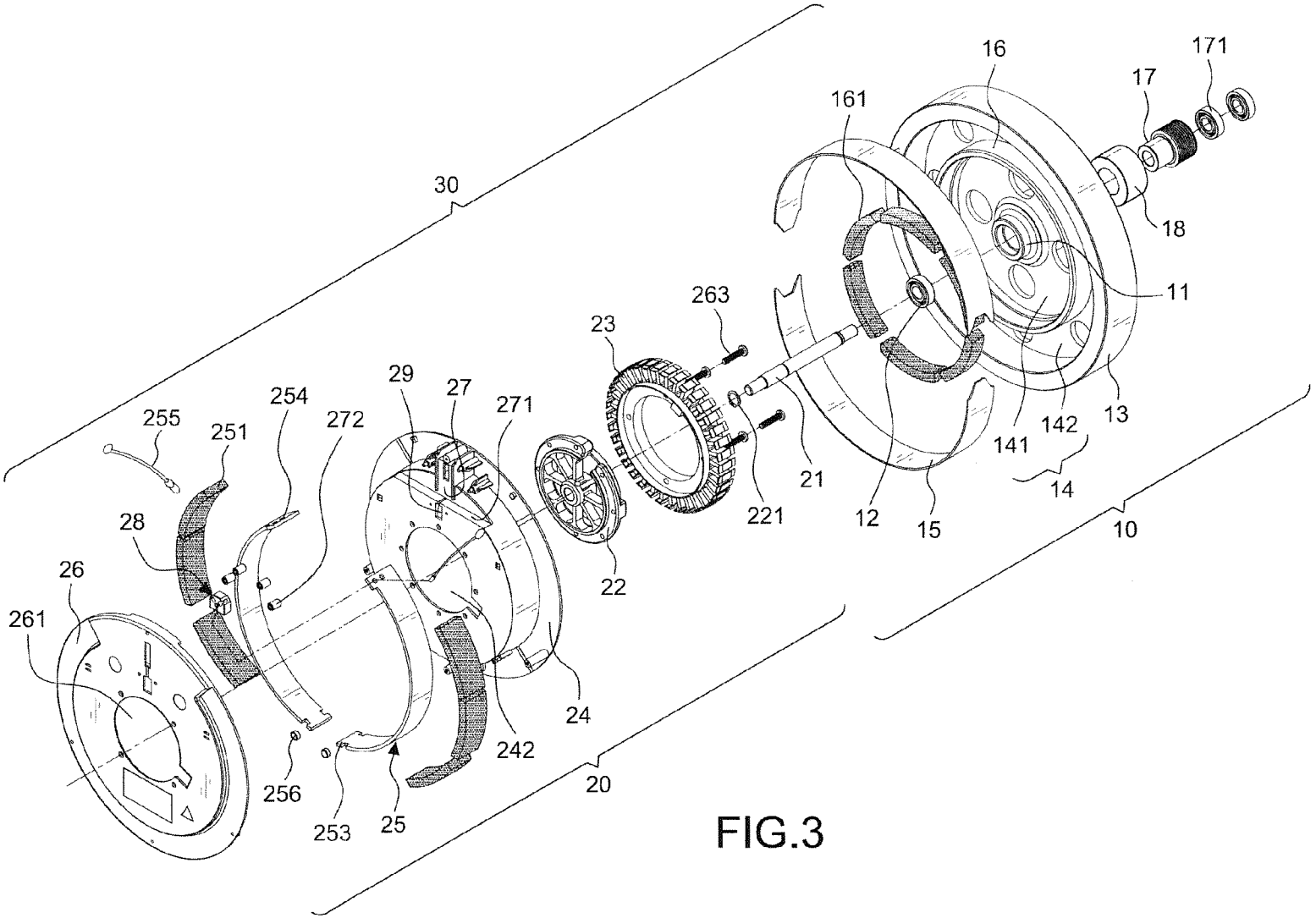
FIG. 3 is an exploded perspective view of the preferred embodiment in accordance with the present invention from another angle.
Figure 4:
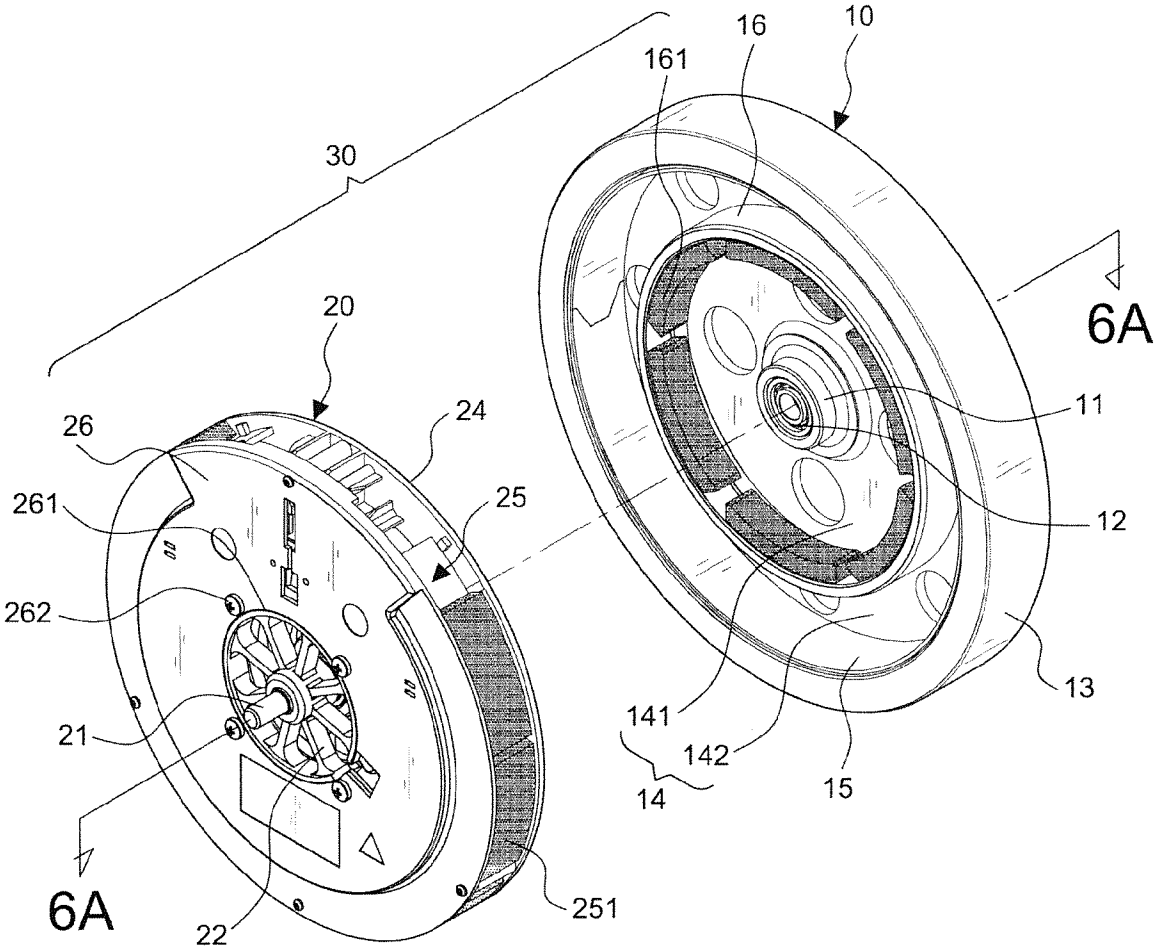
FIG. 4 is an exploded perspective view of the flywheel device and magnetic controlled loading device in accordance with the present invention.
Figure 5:
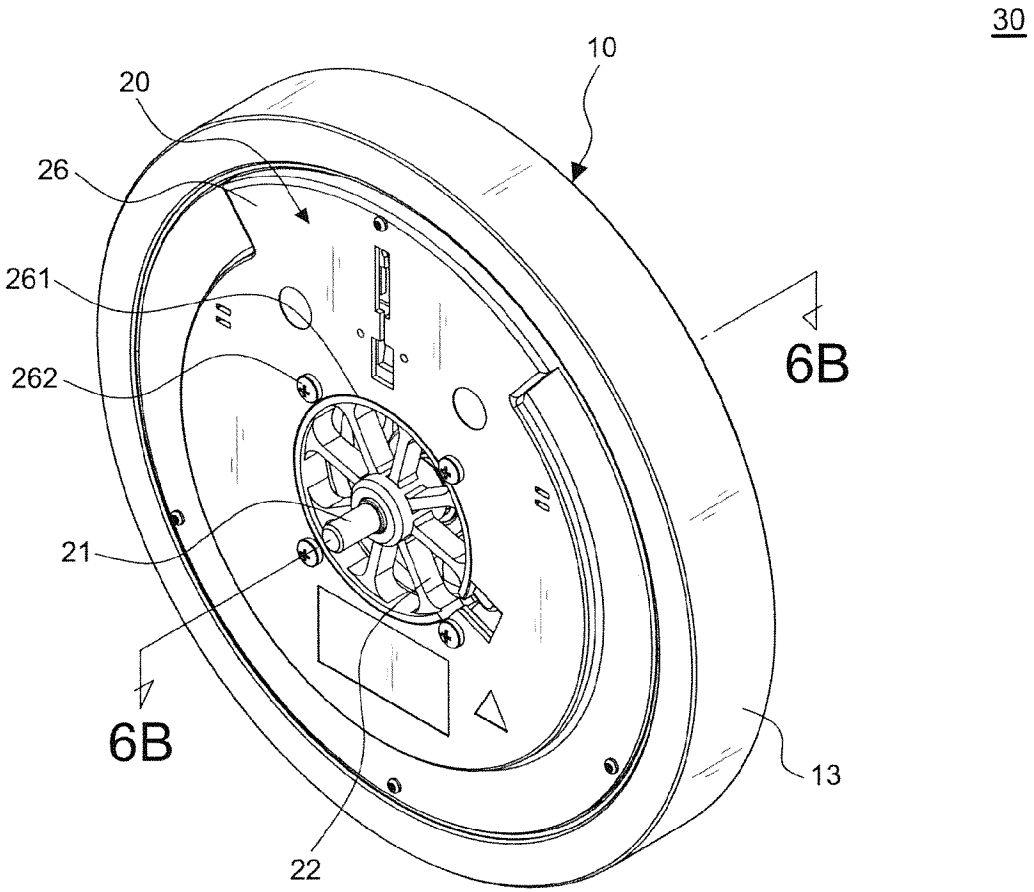
FIG. 5 is an assembly perspective view of the flywheel device and magnetic controlled loading device in accordance with the present invention.
Figure 6A:
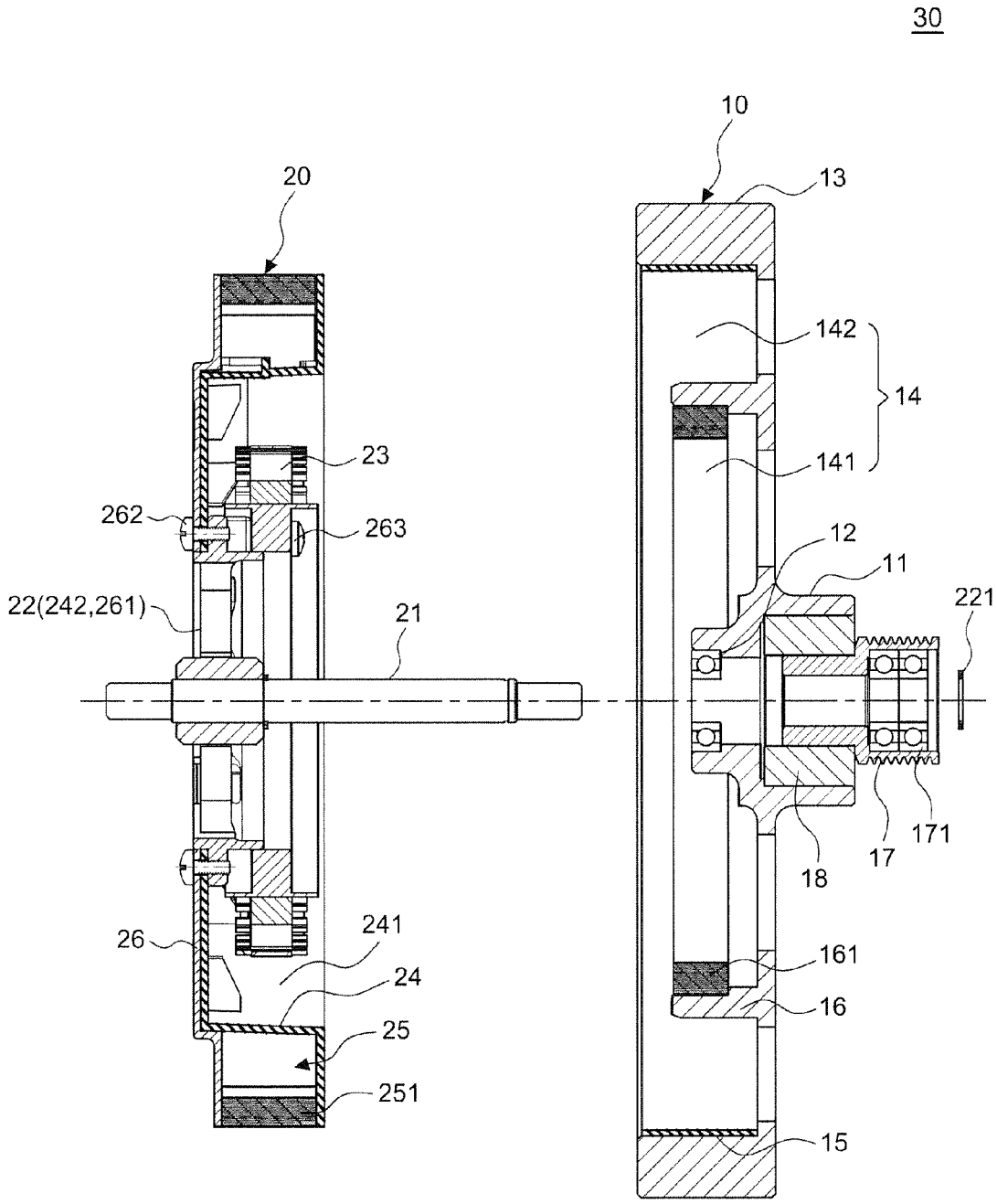
FIG. 6A is a cross-section view taken along the line 6A-6A in FIG. 4.
Figure 6B:
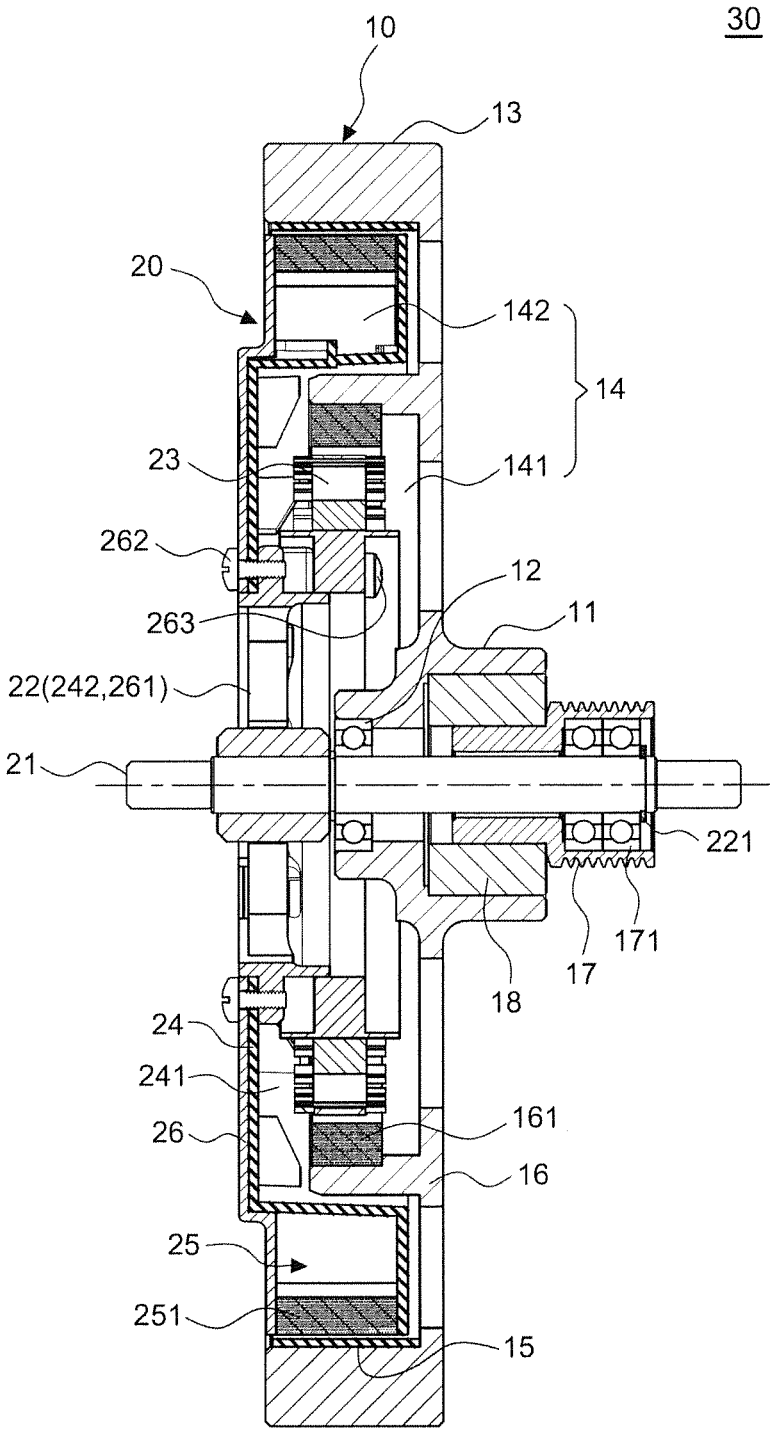
FIG. 6B is a cross-section view taken along the line 6B-6B in FIG. 5.

Referring to FIGS. 1 through 8, the preferred embodiment of a magnetic controlled power generator in accordance with the present invention comprises the following components as discussed in detail below.

A flywheel device 10 having a first bearing 12 disposed within a hub 11 of the flywheel device 10, the flywheel device 10 being recessed under a wheel rim 13, which forms an accommodating space 14, a metal conductor 15 being mounted on an inner surface of the wheel rim 13; a magnetic controlled loading device 20 arranged within the accommodating space 14 of the flywheel device 10 to form a magnetic controlled power generator 30. The above features are disclosed in prior art and thus will not be described in details here.

The present invention is characterized in that the flywheel device 10 includes an annular body 16 being arranged within the accommodating space 14 and being concentric with an axis of the hub 11 to form an inner annular groove 141 and outer annular groove 142 within the accommodating space 14, the annular body 16 has a first magnet 161 at an inner side thereof, a transmission element 17 is arranged at an outer side of the flywheel device 10 to drive the flywheel device 10 for rotation, and the transmission element 17 has at least a second bearing 171 inserted therein The magnetic controlled loading device 20 includes a coil holder 22; a shaft 21 penetrating through the coil holder 22; an armature core 23 mounted to a rear side of the coil holder 22; a rear frame 24 having a groove 241 opposing to the armature core 23 in the center of a shaft hole for arranging the armature core 23, the armature core 23 being fitted in the inner annular groove 141 of the accommodating space 14 for the rotation of the first magnet 161 of the annular body 16 corresponding to the electricity generation of the fixed armature core 23, the groove 241 having a first positioning hole 242 in the center corresponding to a front side of the coil holder 22 thereof; a pair of pole pieces 25 being opposite facing circular shapes and having a pair of second magnets 251 arranged on an outer side 10 thereof and a compression spring 252 fitted to an inner side thereof, the pole pieces 25 each further having an end swiveled in a pivot 253 and a movable free end 254, the pivot 253 of the pole pieces 25 being diagonally positioned on the rear frame 24, a pull rope 255 being joined to the free end 254; a front frame 26 adapted to match the rear frame 24, the front frame 26 having a second positioning hole 261 corresponding to the first positioning hole 242, the front frame 26 being joined to the rear frame 24 and the coil holder 22 with a plurality of screws 262, 263 so that the pole pieces 25 are located between the two frames 24, 26 and fitted in the outer annular groove 142 of the accommodating space 14; a slide 27 and a stepped surface 271 being arranged near the pull rope 255 between the two frames 24, 26, the slide 27 being radially located on a top of the stepped surface 271; an adjustment block 28 being arranged within the slide 27 for radial displacement, the adjustment block 28 having two positioning grooves 281 facing to the corresponding pull ropes 255 at the free ends 254 of the pole pieces 25 and formed at both sides of the adjustment block 28 for the pull ropes 255 respectively passing through both sides of the slide 27 to the two positioning grooves 281; an adjusting drive mechanism 29 passing through the stepped surface 271 to connect a lower end of the adjustment block 28, which is selectable to use an electric or a manual adjustment method to drive the adjustment block 28 for a radial sliding movement.

With the references to FIGS. 4, 5, 6A and 6B, the shaft 21 of the magnetic controlled loading device 20 joints to the hub 11 of the flywheel device 10 to form the magnetic controlled power generator 30. In the embodiment, the shaft 21 has a C-buckle 221 fixed at a rear end of the shaft 21 and abutted to the second bearing 171, but it is not a limitation. Further, the present invention further comprises a one-way clutch bearing 18 arranged between the hub 11 and the transmission element 17.

Figure 7:
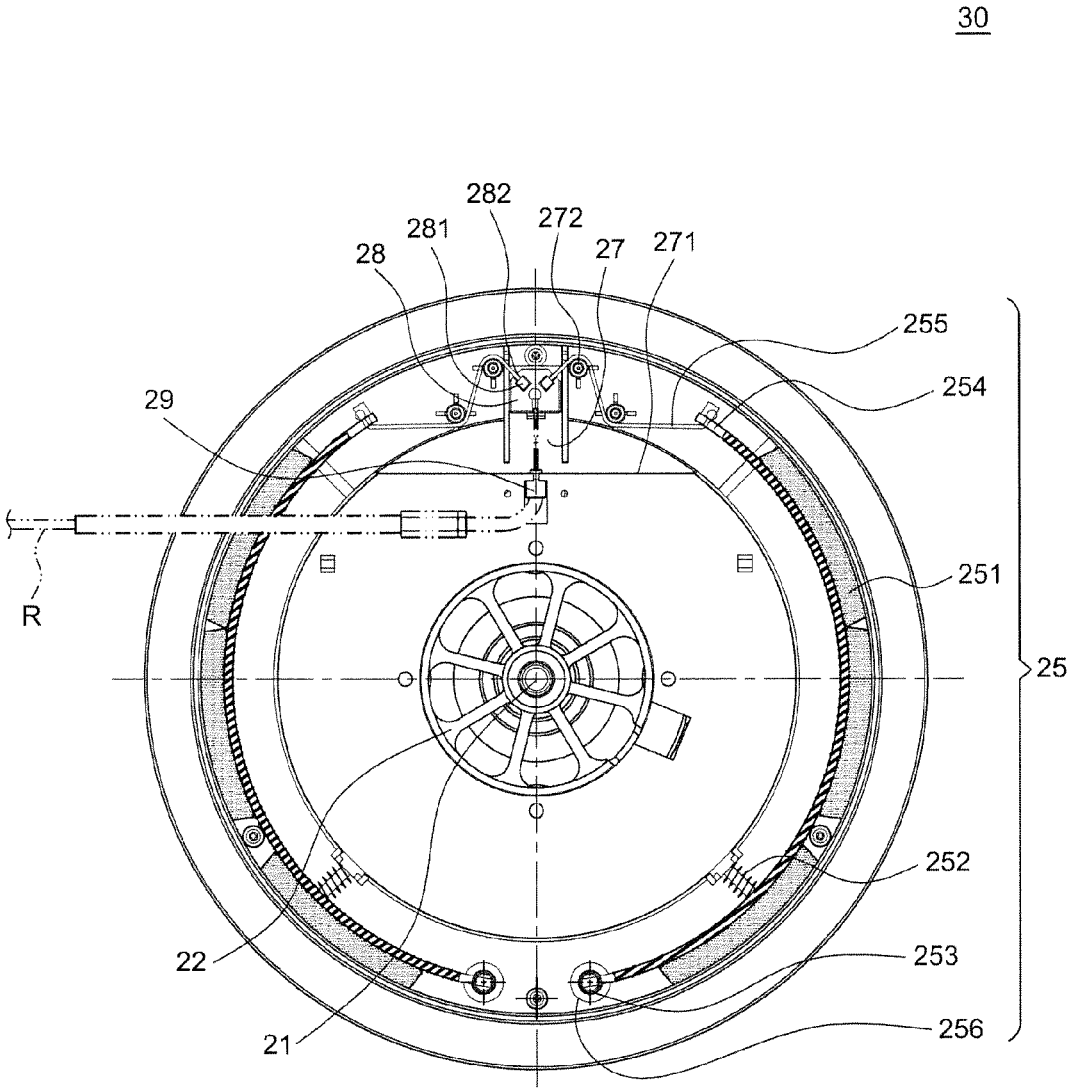
FIG. 7 is an application example of the adjustment block moving upward in the slide in accordance with the present invention.
Figure 8:
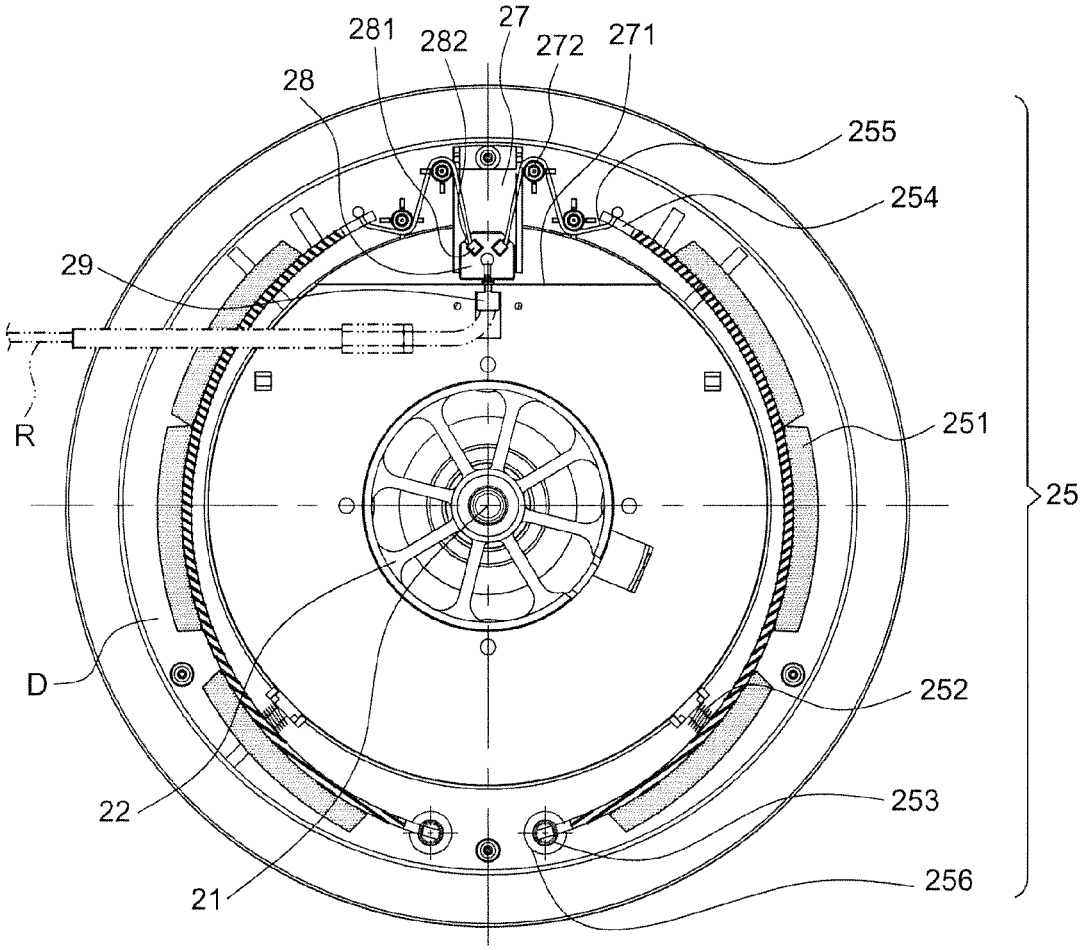
FIG. 8 is an application example of the adjustment block moving downward in the slide in accordance with the present invention.

With the references to FIGS. 7 and 8, the adjustment block 28 is moved up and down in the slide 27. The slide 27 has a plurality of rollers 272 pivotally connected between the two frames 24, 26, and the plurality of rollers 272 is symmetrically located at the top to the bottom of both sides of the slide 27. The pull ropes 255 respectively circles around the rollers 272 and passes through a side of the slide 27 to connect to the positioning groove 281. The adjustment block 28 has an inclined face 282 at an upper surface thereof, and the inclined face 282 is parallel to the positioning groove 281. Further, the pivot 253 has a bush 256 thereon. Furthermore, a control cable R is connected to the adjusting drive mechanism 29 to move the adjustment block 28 up and down.

In the embodiment, when the flywheel device 10 turns, the power is supplied to the adjusting drive mechanism 29 to drive the adjustment block 28 for radial displacement in the slide 27. When the adjustment block 28 moves up or down, the left and right pull ropes 255 allows the free end 254 of the pole pieces 25 to swivel on the pivots 253. As a result, the air gap D between the second magnets 251 and the metal conductor 15 is adjustable to permit the change of the magnetic flux density. In this way, the goal of automatic and continuous adjustment of the loading resistance can be achieved.

Based on the features disclosed, the present invention has following effects:

1. Through the design, each component is effectively disposed in the limited space to form two independent modules for easy assembly and disassembly; such that, the manufacturing and maintenance of sports equipment become more convenient.

2. The adjusting drive mechanism 29 drives the adjustment block 28 for radial displacement in the slide 27 to adjust the air gap D to complete the load adjustment by magnetic control, improving the accuracy of magnetic control on the load adjustment and achieving computerization and digitization.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A magnetic controlled power generator, comprising:

a flywheel device having a first bearing disposed within a hub of the flywheel device, the flywheel device being recessed under a wheel rim, which forms an accommodating space, a metal conductor being mounted on an inner surface of the wheel rim;

a magnetic controlled loading device arranged within the accommodating space of the flywheel device to form a magnetic controlled power generator;

wherein the flywheel device includes an annular body being arranged within the accommodating space and being concentric with an axis of the hub to form an inner annular groove and outer annular groove within the accommodating space, the annular body has a first magnet at an inner side thereof, a transmission element is arranged at an outer side of the flywheel device to drive the flywheel device for rotation, and the transmission element has at least a second bearing inserted therein; and the magnetic controlled loading device includes a coil holder;

a shaft penetrating through the coil holder;

an armature core mounted to a rear side of the coil holder;

a rear frame having a groove opposing to the armature core in the center of a shaft hole for arranging the armature core, the armature core being fitted in the inner annular groove of the accommodating space for the rotation of the first magnet of the annular body corresponding to the electricity generation of the fixed armature core, the groove having a first positioning hole in the center corresponding to a front side of the coil holder thereof;

a pair of pole pieces being opposite facing circular shapes and having a pair of second magnets arranged on an outer side thereof and a compression spring fitted to an inner side thereof, the pole pieces each further having an end swiveled in a pivot and a movable free end, the pivot of the pole pieces being diagonally positioned on the rear frame, a pull rope being joined to the free end;

a front frame adapted to match the rear frame, the front frame having a second positioning hole corresponding to the first positioning hole, the front frame being joined to the rear frame and the coil holder with a plurality of screws so that the pole pieces are located between the two frames and fitted in the outer annular groove of the accommodating space;

a slide and a stepped surface being arranged near the pull rope between the two frames the slide being radially located on a top of the stepped surface;

an adjustment block being arranged within the slide for radial displacement, the adjustment block having two positioning grooves facing to the corresponding pull ropes at the free ends of the pole pieces and formed at both sides of the adjustment block for the pull ropes respectively passing through both sides of the slide to the two positioning grooves; and an adjusting drive mechanism passing through the stepped surface to connect a lower end of the adjustment block, which is selectable to use an electric or a manual adjustment method to drive the adjustment block for a radial sliding movement;

whereby the shaft of the magnetic controlled loading device joints to the hub of the flywheel device to form the magnetic controlled power generator.

2. The magnetic controlled power generator as claimed in claim 1, wherein the shaft has a C-buckle fixed at a rear end of the shaft and abutted to the second bearing.

3. The magnetic controlled power generator as claimed in claim 1, wherein the slide has a plurality of rollers pivotally connected between the two frames; the plurality of rollers is symmetrically located at the top to the bottom of both sides of the slide; the pull ropes respectively circles around the rollers and passes through a side of the slide to connect to the positioning groove.

4. The magnetic controlled power generator as claimed in claim 1, wherein the adjustment block has an inclined face at an upper surface thereof; the inclined face is parallel to the positioning groove.

5. The magnetic controlled power generator as claimed in claim 1, wherein the pivot has a bush thereon.

6. The magnetic controlled power generator as claimed in claim 1, further comprising a one-way clutch bearing between the hub and the transmission element.

* * * * *